US005283744A

United States Patent [19]

Abumehdi et al.

[11] Patent Number: 5,283,744

[45] Date of Patent: Feb. 1, 1994

[54] FRANKING MACHINE

[75] Inventors: Cyrus Abumehdi, Harlow; Raymond J. Herbert, Leigh-on-Sea, both of United Kingdom

[73] Assignee: Alcatel Business Systems Limited, Essex, United Kingdom

[21] Appl. No.: 724,217

[22] Filed: Jul. 1, 1991

[30] Foreign Application Priority Data

Jul. 4, 1990 [GB] United Kingdom ..... 9014827

[51] Int. Cl.[5] ..... G07B 17/00

[52] U.S. Cl. ..... 364/464.02; 364/464.03

[58] Field of Search ..... 364/464.02, 464.03

[56] References Cited

U.S. PATENT DOCUMENTS

| | | | |
|---|---|---|---|
| 4,168,533 | 9/1979 | Schwartz | 364/464.02 X |
| 4,858,138 | 8/1989 | Talmadge | 364/464.02 |
| 4,918,631 | 4/1990 | Hara et al. | 364/708 |
| 4,956,782 | 9/1990 | Freeman et al. | 364/464.02 X |

FOREIGN PATENT DOCUMENTS

| | | |
|---|---|---|
| 0197345 | 10/1986 | European Pat. Off. . |
| 0225068 | 6/1987 | European Pat. Off. . |
| 0352498 | 1/1990 | European Pat. Off. . |
| 2166389 | 5/1986 | United Kingdom . |
| 2206082 | 12/1988 | United Kingdom . |

*Primary Examiner*—Edward R. Cosimano

*Attorney, Agent, or Firm*—Shoemaker and Mattare, Ltd.

[57] ABSTRACT

A franking machine for accounting for postage value used in franking items to be carried by postal authority or other carrier is constructed of electronic circuits specifically constructed to carry out specific functions and implemented by ASIC technology. Circuits for carrying out accounting functions, controlling a printing device to print franking impressions containing fixed pattern information and variable postage information are described.

7 Claims, 5 Drawing Sheets

FRANKING MACHINE

BACKGROUND OF THE INVENTION

This invention relates to franking machines and in particular to franking machines incorporating electronic circuits to carry out accounting and control functions.

FIELD OF THE INVENTION

In known franking machines incorporating electronic circuits, an integrated circuit microprocessor is operated under program routines stored in a read only memory to carry out accounting functions in which, for example in a pre-payment franking machine, a value of credit is stored in a register and when the machine effects a franking operation involving usage of postal value the value of credit is decremented and the new decremented value is written to the register to be stored until the next franking operation. In addition other data items are stored in registers and operated upon by the microprocessor during a cycle of franking operation and the updated values of the data items are written to the registers. These data items may for example comprise a tote value which is the accumulated total of postal value used in franking operations, a count of the number of items franked and a count of items franked with a value in excess of a predetermined value.

Previously it has only been economical to manufacture integrated circuits in very large numbers and hence only those circuits for which there has been a very large demand have been produced and marketed. This led to the design and manufacture of microprocessor integrated circuits. These microprocessors are designed to operate in conjunction with program routines and in dependence upon the program routines can be caused to perform a plurality of different operations in sequence. Each program routine comprise a series of instructions held in a memory. When a program routine is selected to be performed by the microprocessor, a central processor unit of the microprocessor reads the instructions sequentially from the memory by sending a series of location address signals on memory address lines. The central processing unit takes the instructions, read from memory, sequentially and carries out actions in dependence upon the instructions. Accordingly by writing different program routines a single design of microprocessor can be utilised for a very large number of different tasks in a wide variety of applications. As a result of this widespread application of microprocessors, the devices have been readily available at economical prices to manufacturers of equipment incorporating these devices. The equipment manufacturer is able, by the writing of program routines specific to the intended equipment operation, to cause the microprocessor to carry out the required operations for that specific equipment.

However for equipment requiring a relatively small number of different operations to be performed, microprocessors are un-necessarily complex. Furthermore due to the ability of the microprocessor to carry out a large variety of operations under the control of program instructions there is a possibility of error in carrying out the required operations.

The production process for the manufacture of integrated circuits has now progressed such that it is practical to design and manufacture integrated circuit devices to individual requirements even for relatively low numbers of devices at a cost which is economical to equipment manufacturers.

SUMMARY OF THE INVENTION

According to the invention a franking machine includes an accounting circuit to carry out accounting functions in relation to postage values used in franking mail items; memory means to store accounting data generated by the accounting circuit; control circuits to carry out control functions to control operation of the franking machine; means to input a selected value of postage to the accounting circuit; a print head; feed means operable to feed a mail item past the print head to receive a franking impression; said print head being operable by said accounting and control circuits to print a franking impression including at least a postage value; said accounting and control circuits being constructed as a single integrated circuit.

BRIEF DESCRIPTION OF THE DRAWING

An the invention will now be described by way of example with reference to the drawings in which.

DESCRIPTION OF THE PREFERRED EMBODIMENT

Figure 1:
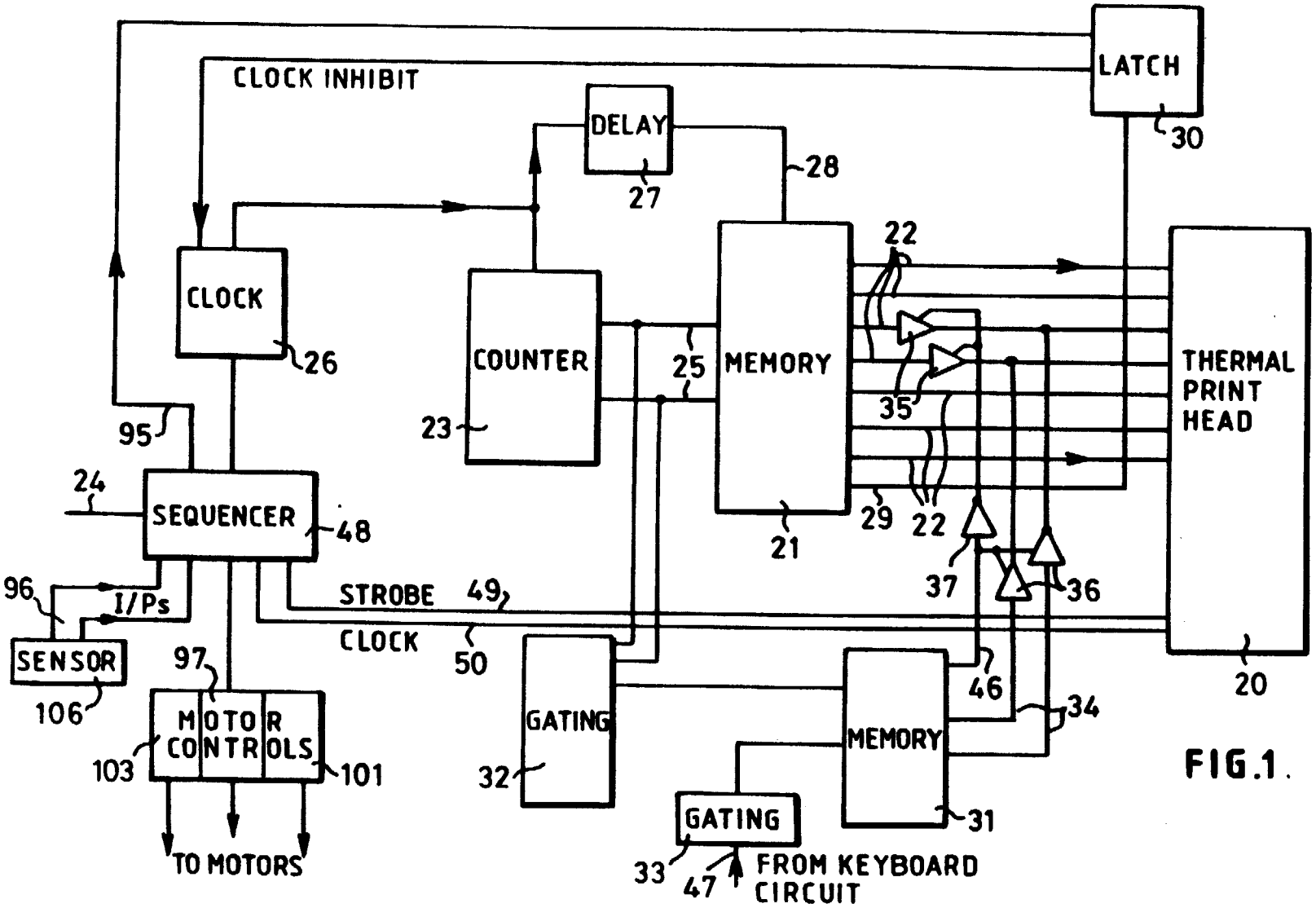
FIG. 1 is a block circuit diagram of a circuit to control a print head to print franking impressions.

The operation of a franking machine comprises a number of functions as follows:

1) printing of a franking impression on a mail item
2) Accounting during franking operation
3) Update of Credit by means external to franking machine
4) Display of information to user of machine
5) Keyboard operation
6) Monitoring of sensors
7) Control of motor drives In the franking machine to be described hereinafter these functions are performed by individual circuits and are not performed under the control of one element or circuit as is the case with franking machines incorporating microprocessors. The individual circuits are designed to perform specific functions respectively.

Referring to the circuit of FIG. 1, a thermal transfer print head 20 incorporates 7 registers (not shown) each of 32 bits. Each bit of the registers is associated respectively with a different one of a plurality of resistive thermal printing elements of the head. Information representing a fixed part of a franking impression to be printed is held in a memory 21 and is read from the memory and loaded to the print head in a plurality of print cycles. The information is read as 8 strings in parallel, each string comprising 32 serial bits. The information read from the memory comprises 7 strings of print data output onto lines 22 and written in parallel to the 7 registers of the print head and an eighth string of control bits. In the print data strings, a logic '1' bit represents a thermal element to be energised to print a dot and a logic '0' bit represents a thermal element which is not to be energised. Each print cycle therefore consists of 32 load cycles on the 7 input lines 22. The memory 21 is addressed by a counter 23 having outputs connected to the memory address lines 25. The counter is incremented by print clock signals from a print clock 26 and hence the memory locations are addressed sequentially one at a time to read out an 8 bit byte comprising 7 bits of print data on the lines 22 and an eighth bit comprising a control bit on line 29. Read out from the memory 21 is enabled at a predetermined time, after the memory address lines have been selected, by a clock signal delayed by delay 27 applied to memory enable input 28. The control bit on line 29 is utilised to signal an end of print data. This control bit is '0' for bytes 0 to 30 and is '1' for the final byte to signify the end of the print data. The line 29 is connected to switch a latch 30 to inhibit the clock 26.

Each print cycle causes the thermal print head to print a column of dots at selected positions so that in a succession of print cycles the franking impression is printed column by column to build up the entire franking impression.

A franking impression comprises a fixed pattern together with variable data consisting of the postal value of the franking and the date on which the franking is printed. The fixed pattern of the franking impression includes information, such as information which is fixed relative to a specific franking machine, comprising the license number of the franking machine and the postal district in which the franking machine is operated.

The information loaded in the memory 21 comprises data relating to the fixed part of the franking impression and hence the print data input via the lines 22 to the print head represents the required energisation of the print elements to print the fixed part of the impression. A second memory 31 is provided to store a table which can be accessed to effect printing of variable data as part of the franking impression. The second memory 31 is controlled by gate circuits 32, 33. As described hereinbefore, the fixed part of the franking impression is printed column by column. Similarly variable data such as postage charge and date are printed column by column and the memory 31 stores variable data in table form such that the variable data can be accessed column by column. Gate circuit 32 monitors the address lines 25 of memory 21 to detect when an address at which variable data is required to be printed is selected by the counter 23. When an address corresponding to a column of the impression at which variable data is to be printed is detected, by gate circuit 32, the gate circuit 32 addresses memory 31 to select the required column of the variable data. In addition the memory 31 is addressed by gating circuit 33 to select the character, for example the digit of a postage value or date, required to be printed in the franking impression. The gating circuit 33 is controlled by an input on line 47 from a keyboard circuit to be described hereinafter. The characters for the postage value digits and for the date are usually required to be of different size and hence these are stored as separate sets in the memory 31.

The variable information is printed in a central area of the franking impression. Accordingly the variable part of the franking impression is confined to the print data loaded into two registers of the print head associated with the central part of the columns of print forming the franking impression. Therefore output from the memory 31 is by means of only two output lines 34 and these are connected to two of the lines 22 respectively. The print data bits relating to fixed information from the memory 21 and the print data bits relating to variable information from the memory 31 are steered by means of tri-state buffers 35 connected in the two lines 22 and tri-sate buffers 36 in lines 34. Buffers 36 are controlled by a gating signal output from memory 31 on line 46 and buffers 35 are controlled by the gating signal on line 46 after inversion by an inverter 37. Accordingly when there is an output from memory 31 representing variable data, the memory 31 also outputs a gating signal effective to open the buffers 36 and to close the buffers 35. At times when there is no output of data from the memory 31, the gating signal has a state such that the buffers 36 are closed and buffers 35 are open to permit passage of print data from the memory 21. Operation of the print head 20 is controlled by a sequencer circuit 48 which provides strobe and clock signals to the print head on lines 49 and 50 respectively. The sequencer circuit 48 also provides a de-latch signal on line 95 to latch circuit 30 to enable the clock 26 at the start of a print cycle. Initiation of printing of a franking impression by the printing circuit of FIG. 1 is effected by a trip input signal on line 24 to the sequencer circuit 48.

Figure 2:
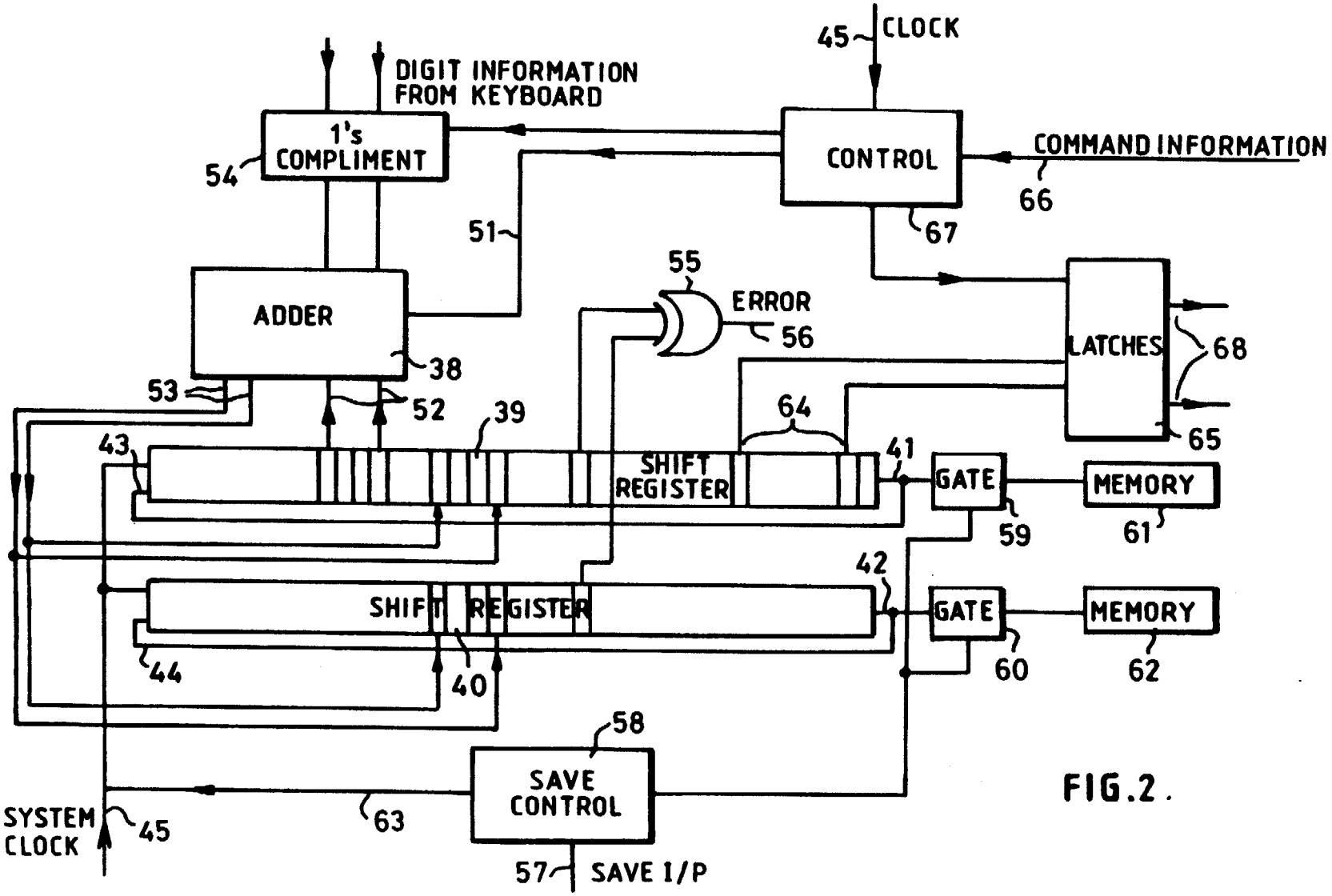
FIG. 2 is a block circuit diagram of a circuit to carry out accounting functions.

Referring now to FIG. 2, an accounting circuit comprises a full adder 38 and two recirculating shift registers 39, 40 in which the serial outputs 41, 42 thereof are connected to the serial inputs 43, 44 respectively thereof. Data in the shift registers 39, 40 is recirculated continuously by system clock signals on line 45. The shift registers each have a sufficient number of storage stages to store all the required items of account and current value data as a serial string. The adder 38 receives postage value inputs from the keyboard circuit During a franking cycle, after the franking machine has been committed to printing the franking impression, the digits of the value information are input from the keyboard circuit. Operation of the adder is controlled by a control signal on line 51 such that the adder receives an input on lines 52 from four stages of the shift register 39 at a series of time periods during which the bits of a data item to which the inputs from the thumb wheels are to be added, or subtracted, are shifted into those stages of the register. Output from the adder is applied via lines 53 to stages of each shift register 39, 40 in a time period at which the bits of that data item being modified by the adder are shifted into those stages. Thus addition, or subtraction, of a postage value input from the keyboard circuit to the value of a data item circulating in the shift registers 39, 40 by the adder 38 is timed such that the bits of the required data item are shifted into storage stages of the register aligned with the input 52 and output 53 of the adder 38. Decrementing of a data item in the shift registers is accomplished by routing the updating value from the keyboard circuit via a 1's complimenter 54. The 1's compliment section operates under control of an input from the control circuit 67. Thus the 1's compliment is synchronised with data requiring subtraction of value. A data item consisting of a credit value available for use in franking is decremented by routing the input value from the keyboard circuit via the 1's complimenter and adding the 1's compliment to the data item when that item is read from the storage stage connected to the input 52 of the adder. A data item consisting of the tote value, the accumulated value of postage used in franking, is updated by adding the value input from the keyboard circuit when that data item is read from the storage stage connected to the input of the adder. The binary values corresponding to the decimal digits of the values are added one decade at a time by the adder. In addition to outputting the modified data item from the adder to the shift register 39, the modified data item is also written into the corresponding stage of the shift register 40.

Instead of the postage values being input by keyboard entry, the values may be input by operation of encoder switches.

The two shift registers 39, 40 are identical and recirculate the same information in synchronism. Updating operations by the adder 38 are performed at the same time on the same data items in both registers. If the shift registers are operating correctly without fault, the data in both registers at any instant in time is identical and the state of any storage stage of one register is identical to the state of a corresponding stage in the other register. In order to check the operation of the registers, a corresponding stage of each register is connected to the inputs of an exclusive OR gate 55. If the output from the stage of one register differs from the output of the corresponding stage of the other register the exclusive OR gate provides an error signal output on line 56.

During normal powered operation of the franking machine, the information in the shift registers 39, 40 continues to recirculate around the shift registers. When the application of power to the franking machine is terminated, either by being turned off or due to a power supply fault, a power down save operation is carried out. The power down save operation is initiated by detection of a low voltage condition which generates a save signal input on line 57 to a save control circuit 58. Upon initiation by the input on line 57, the save control circuit opens gates 59, 60 respectively connecting duplicate non-volatile memories 61, 62 to the outputs 41, 42 of the shift registers 39, 40 and generates clock signals on line 63 to shift all the data items in the shift registers into the memories 61, 62. The memories have a serial input for data and may be electrically erasable devices. Although such devices generally are limited by a relatively low number of erase cycles, they are adequate for the present purpose because they are written to only upon power down of the franking machine. When power is re-applied to the franking machine, the gates 59, 60 are opened to permit the data items to be serially output from the memories 61, 62 to the inputs 43 44 of the shift registers 39, 40.

Information to be displayed by a display device is read out in parallel from a group of stages 64 of one of the shift registers, from shift register 39 as shown in FIG. 2. A plurality of latches 65 are connected to the stages 64 of the group. The latches are enabled to be set to states corresponding to the stages of the group of storage stages at a time when the bits of a data item required to be displayed are located in the group of stages 64. Selection of a data item to be displayed is effected by operation of a key switch by a user. Signals on line 66 from the keyboard circuit are applied to a control circuit 67 which also receives system clock signals. The output of the control circuit 67 enables the latches 65 during a clock period at a time determined by the signal on line 66. The setting of the latches represents the bits of the data item read from the shift register 39 and outputs from the latches are utilised to drive a display device connected to display data lines 68. Read out of the shift register in this manner enables any selected data item to be read and displayed. For example, the latches may be enabled at a time to read out the credit value or may be enabled at a time to read out the tote value.

Figure 3:
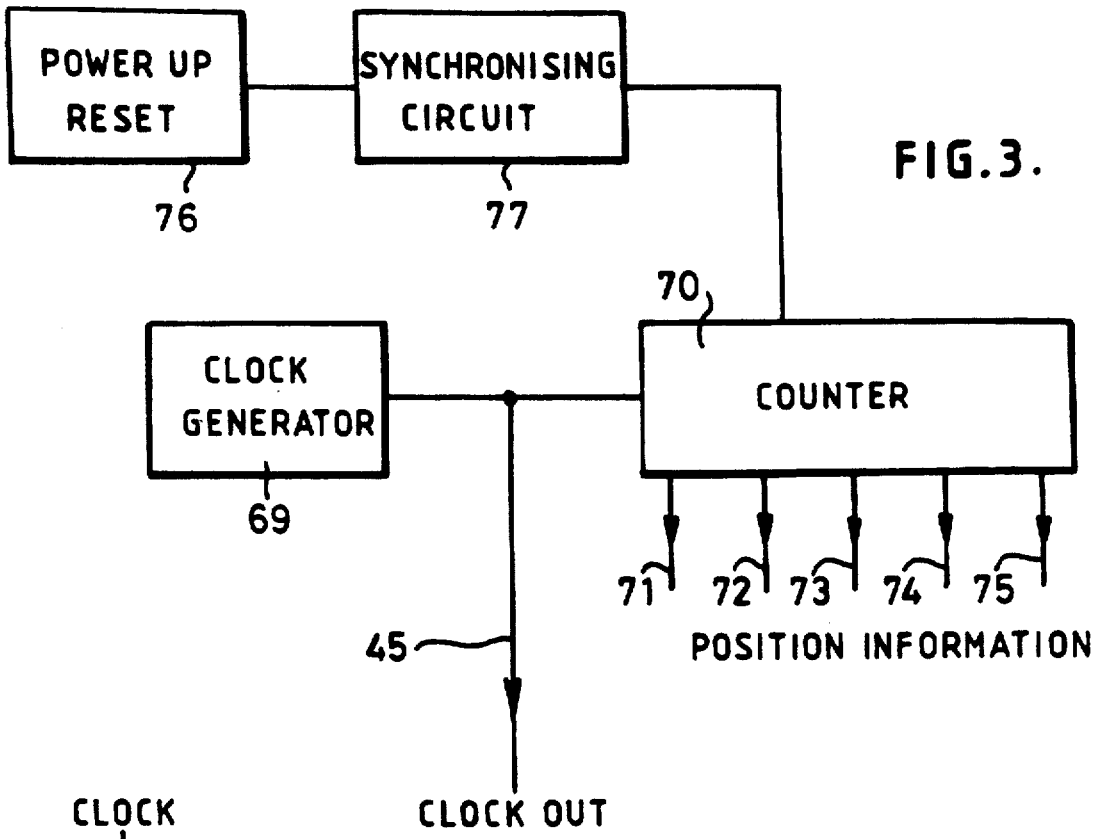
FIG. 3 is a block circuit diagram of a timing control circuit.

Referring now to FIG. 3, system clock signals are generated by a generator 69. These clock signals are output on line 45 to control operation of circuits shown in FIG. 2, for example the shifting of data in the shift registers. The clock signals are also applied to a counter 70 of the control circuit 67 which divides down the clock signals in multiple stages to produce position control signals on lines 71-75. The division ratio corresponds to the relationship between the data items in each of the shift registers 39, 40. Thus an output on line 71 will effect read out of one item of data from the register 39 for display while outputs on other ones of the lines 71-75 will effect read out of other items of data for display. Similarly the outputs on lines 71-75 are utilised to control timing of the operation of the adder 38 to update a selected data item in the shift registers.

When power is applied to the franking machine after a period of inoperation, a power up reset circuit 76 senses the presence of an operating voltage level and operates a synchronising circuit 77 to reset the counter 70 of the control circuit 67 to zero whereby the counter outputs on lines 71-75 are synchronised with positions of the data items in the recirculating shift registers 39, 40.

Updating of the value of credit stored in the franking machine may be accomplished by the use of equipment external to the franking machine. The credit updating equipment may be connected to the memories 61, 62 by means of the gating circuits 59, 60 to permit the data stored in the memories to be read out to the external equipment. The external equipment includes means to modify the credit value data to reflect the amount of additional credit and the modified credit value data is then written into the memories 61, 62. It will be understood that means to provide security of the data and to prevent fraudulent modification of the credit value and other data items stored in the memories would be provided. Such security means may include means to include encoded signals so that only genuine credit updating signals from authorised external equipment are accepted by the franking machine. Writing of data to the memories from the external equipment would be inhibited except when the franking machine receives correct genuine credit update signals. The provision of security in updating of credit values in a franking machine is well known and it is believed to be un-necessary to describe this herein in detail.

Figure 4:
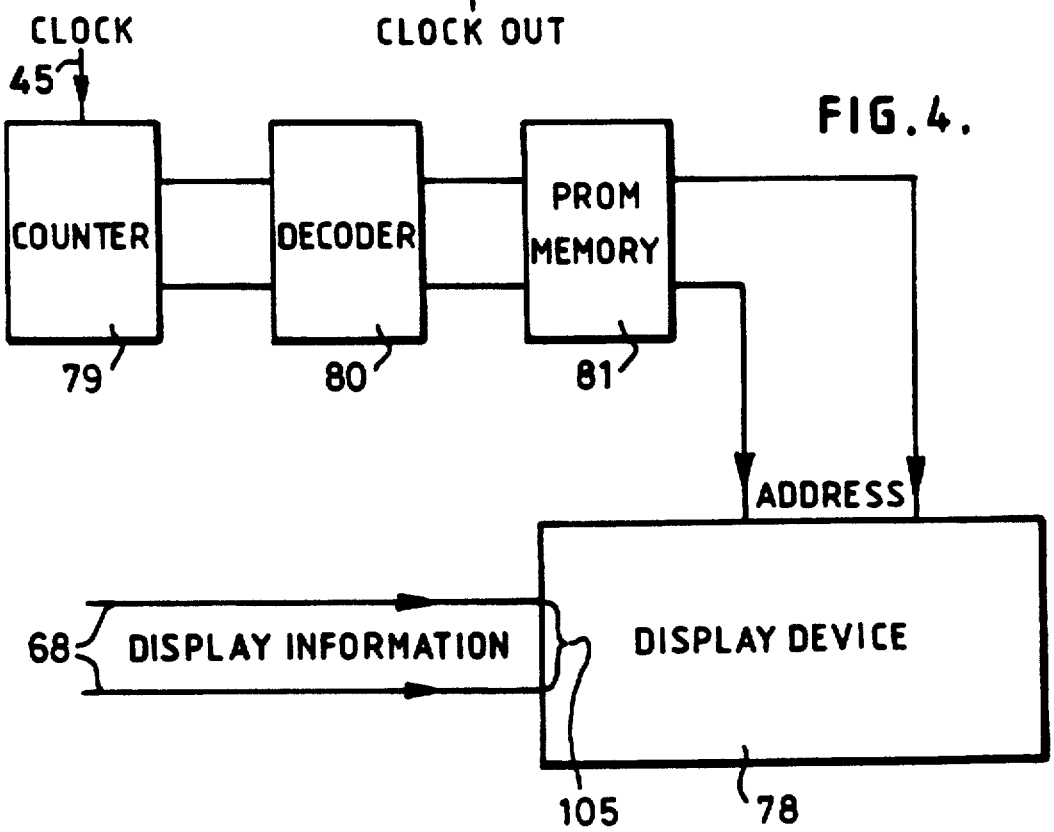
FIG. 4 is a block circuit diagram of a display device and driver circuits therefor.

Referring now to FIG. 4, a display device 78 for the display of selected data items stored in the shift register 39 comprises a liquid crystal display module having a dot matrix format. The display device 78 is treated as if it is a random access memory and display data is written to the addresses, which correspond to dot positions in the matrix formation. Conveniently the module may have a capacity to display two rows of sixteen characters. The outputs of the latches 65 (FIG. 2) on display data lines 68 are applied in parallel to a data input 105 of the display device 78. A counter 79 is incremented by system clock signals on line 45. The count of counter 79 is decoded by decoder 80 to address a PROM memory 81 storing addresses of the display device. Since the counter 79 is incremented in step with the shifting of data in the shift register 39 by the system clock signals on line 45, the display addresses of the display device are selected in correspondence with the data in the group of stages 64 of the shift register 39.

Figure 5:
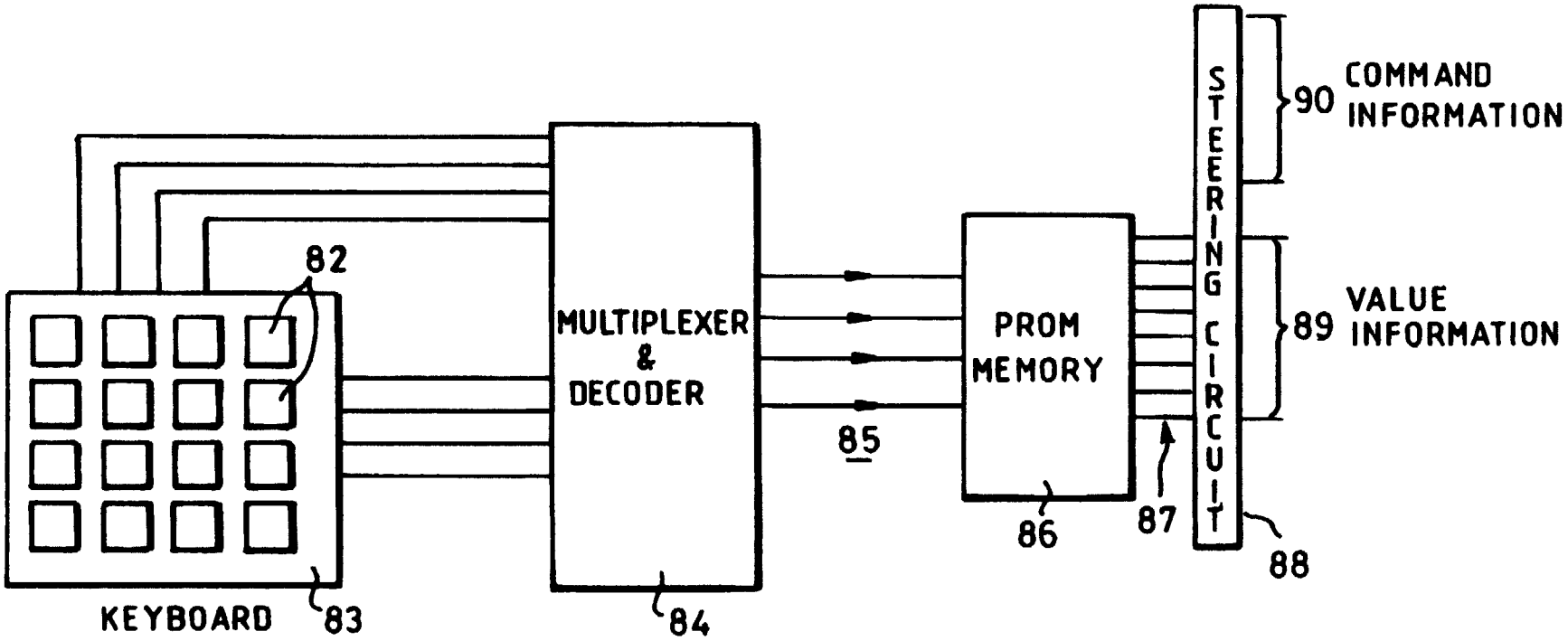
FIG. 5 is a block circuit diagram of a circuit for decoding the output of a keyboard.

FIG. 5 shows a block diagram of a circuit for decoding the output from operation of keys 82 of a keyboard 83. The keyboard 83 has sixteen keys 82 arranged in a four by four format. Ten of the keys respectively represent the digits 0–9 and the remaining six keys relate to function commands. The keyboard is scanned in a conventional manner by multiplexer and decoder 84 to generate a four bit code in parallel on four lines 85 in response to detection of a key press, the four bit code being different for each of the keys. This four bit code is used to address sixteen storage locations of a PROM 86. Each location of the PROM 86 contains an eight bit code, and the eight bit code in an addressed location is read out in parallel on eight lines 87 to a steering circuit 88. The value of the most significant bit of the eight bit code is utilised to signify either that the information represented by the code is a digit value 0–9 or is not a digit value. The value of two bits of the code represent the decade of the digit input by pressing of a key, and four bits of the code represent in hex code the digit values 0–9. When the most significant bit of the code indicates that the code represents a value 0–9, the steering circuit 88 responds to this bit to steer the digit information to value input lines 89 connected to an input of the adder 38.

When the most significant bit of the code read from the PROM 86 signifies that the eight bit code represents command information, the steering circuit 88 responds to this bit of the code to steer the code to command information lines 90 instead of to the value input lines 89.

Figure 6:
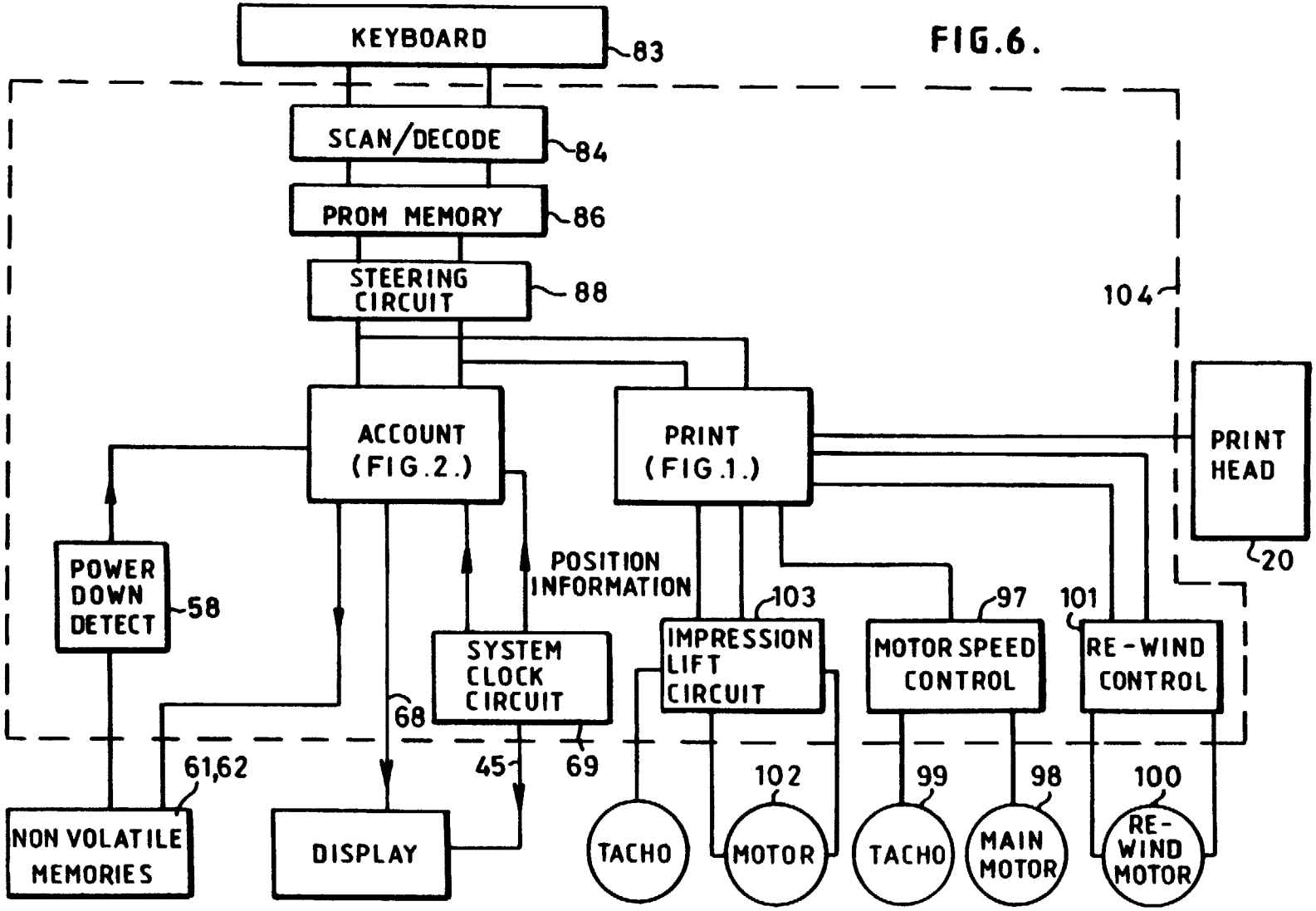
FIG. 6 is a diagram of the overall franking machine.

Referring to FIG. 6, the franking machine includes opto-electric sensing device 106 to detect the position of mail items as they move along a feed path past the print head 20 and provide sensing input signals on line 96 to the sequencer circuit 48 (FIG. 1). An item entering the feed path is detected by the input sensor 106 which causes the sequencer circuit to operate a motor control circuit 97 to actuate a motor drive 98 for a mail item feed to feed the item past the print head. A feedback signal is generated by a tachometer 99 coupled to the mail item feed to enable the motor control circuit 97 to maintain the speed of travel of the mail item substantially constant during the period in which the franking impression is printed on the mail item. Actuation of the motor drive is maintained for the duration of printing of the impression. When the trailing edge of the mail item is sensed by the sensor 106, the resultant signal is delayed and the delayed signal terminates actuation of the motor drive to the feed. Pulses from the tachometer 99 are also utilised to synchronise the operation of the print head drive circuits with the speed of travel of the mail item.

The overall block circuit of the franking machine is shown in FIG. 6 illustrating the interconnection of the accounting circuit of FIG. 2 to the print head drive circuit of FIG. 1, to the display circuit of FIG. 4 and to the keyboard circuit of FIG. 5 and connection of the timing control circuit of FIG. 3 to the accounting circuit and to the display circuit. In addition to the circuits already described hereinbefore, the franking machine includes a ribbon rewind motor 100 operated by a rewind control circuit 101 and an actuator motor 102 operated by an impression lift circuit 103 to control positioning of an impression roller relative to the print head. The re-wind control circuit and impression lift circuit are controlled by the sequencer circuit 48.

In accordance with the invention, print head control circuits, the accounting circuit and control circuits are manufactured as an application specific integrated circuit (ASIC) indicated as the circuits within the broken line 104 in FIG. 6. As a result interconnection between circuit components is effected on the integrated circuit chip and the only external connections to the chip are those required to connect the print head 20, keyboard 83, display 78, the memory devices 61, 62, the opto-electrical sensors and the electro-mechanical devices to the circuits implemented on the chip. Furthermore the use of ASIC technology to implement the construction of the accounting and control circuits enables the operation and function of each of the circuits to be determined by the circuit configuration and not to be dependent upon software routines as is the case when using microprocessors for carrying out various functions.

We claim:

1. A franking machine including an accounting circuit to carry out accounting functions in relation to postage values used in franking mail items; memory means to store accounting data generated by the accounting circuit; control circuits to carry out control functions to control operation of the franking machine; means to input a selected value of postage to the accounting circuit; a print head; feed means operable to feed a mail item past the print head to receive a franking impression; said print head being operable by said accounting and control circuits to print a franking impression including at least a postage value; said accounting and control circuits being constructed as a single integrated circuit; said accounting and control circuits being constructed to carry out specific accounting and control functions respectively; and in which said accounting circuit includes a first recirculating shift register having a first plurality of stages to store bits of a first string of items of accounting data and an adder having first and second inputs and an output for the result of addition of data applied to said first and second inputs; said first input being connected to a first stage of the recirculating shift register and the output being connected to a second stage of the shift register; and control means to control operation of the adder to receive bits of a data item from the first stage and to output bits of the data item, after modification by data applied to the second input, to the second stage of the shift register.

2. A franking machine as claimed in claim 1 including a first print data memory to store first print data relating to fixed portions of the franking impression to be printed and a second print data memory to store second print data relating to variable information to be printed in the franking impression; means to sequentially address locations of the first memory to read out first print data and to load said read out first print data into a print buffer register; means operative in response to an input value comprising a postage value or date to select a group of memory locations of said second print data memory; means responsive to addressing of predetermined address locations of the first print data memory to address locations of the selected group of locations of the second print data memory to read out second print data representing said value of postage; gating means operated by a steering signal output from the second memory to inhibit loading of first print data signals and to load second print data signals representing positions in the franking impression at which second print data is to be printed.

3. A franking machine as claimed in claim 1 including first non-volatile memory means and first gating means connecting said first non-volatile memory means and the first shift register; low voltage detection means operative in response to detection of a low voltage condition of power supplied to the franking machine circuits to operate said first gating means to read the string of data items from the first shift register and to write the string to the first non-volatile memory means.

4. A franking machine as claimed in claim 3 including means responsive to powering up of the franking machine circuits to operate the first gating means to read the string of data items from the first non-volatile memory means and to write the string to the first shift register.

5. A franking machine as claimed in claim 1 including a second recirculating shift register having a second plurality of stages corresponding to the stages of the first shift register to store bits of a second string of items of accounting data and shifting means for shifting the bits of data in the first and second shift registers in synchronism.

6. A franking machine as claimed in claim 5 including first non-volatile memory means and first gating means connecting said first non-volatile memory means and the first shift register; second non-volatile memory means and second gating means connecting said second non-volatile memory means and the second shift register; low voltage detection means operative in response to detection of a low voltage condition of power supplied to the franking machine circuits to operate said first gating means to read the first string of data items from the first shift register and to write said first string to said first non-volatile memory means and to operate said second gating means to read the second string of data items from said second shift register and to write said second string to said second non-volatile memory means.

7. A franking machine as claimed in claim 6 including means responsive to powering up of the franking machine circuits to operate the first gating means to read the first string of data items from the first non-volatile memory means and to write the first string to the first shift register and to operate the second gating means to read the second string of data items from the second non-volatile memory means and to write the second string to the second shift register.

* * * * *

UNITED STATES PATENT AND TRADEMARK OFFICE

CERTIFICATE OF CORRECTION

PATENT NO. : 5,283,744

DATED : February 1, 1994

INVENTOR(S) : Cyrus ABUMEHDI and Raymond John HERBERT

It is certified that error appears in the above-identified patent and that said Letters Patent is hereby corrected as shown below:

On the title page, item [73]: Assignee

"ALCATEL BUSINESS SYSTEMS LIMITED
Essex, United Kingdom"

should read

-- NEOPOST LIMITED
Essex RM1 2AR, UNITED KINGDOM --

Signed and Sealed this

Fourteenth Day of March, 1995

Bruce Lehman

*Attest:*

BRUCE LEHMAN

*Attesting Officer*

*Commissioner of Patents and Trademarks*